US005548102A

United States Patent [19]

Kwon

[11] Patent Number: 5,548,102

[45] Date of Patent: Aug. 20, 1996

[54] MICROWAVE OVEN HAVING ROTARY GRILL HEATER

[75] Inventor: Chul-Ho Kwon, Seoul, Rep. of Korea

[73] Assignee: Goldstar Co., Ltd., Seoul, Rep. of Korea

[21] Appl. No.: 363,072

[22] Filed: Dec. 23, 1994

[30] Foreign Application Priority Data

Dec. 23, 1993 [KR] Rep. of Korea ..... 1993-29247
Apr. 22, 1994 [KR] Rep. of Korea ..... 1994-8659

[51] Int. Cl.[6] ..... H05B 6/64
[52] U.S. Cl. ..... 219/685; 219/404
[58] Field of Search ..... 219/685, 762, 219/751, 404, 469

[56] References Cited

U.S. PATENT DOCUMENTS 2,848,592 8/1958 Mergen ..... 219/404
3,281,575 10/1966 Ferguson, Jr. ..... 219/404
4,424,797 1/1984 Perkins ..... 126/247
4,488,025 12/1984 Tanabe ..... 219/685
4,596,914 6/1986 Morino ..... 219/685
4,629,850 12/1986 Tanabe ..... 219/685
4,683,666 8/1987 Igusa et al. ..... 34/67
4,804,812 2/1989 Tanaka et al. ..... 219/685

FOREIGN PATENT DOCUMENTS 56-113928 9/1981 Japan ..... 219/685

*Primary Examiner*—Philip H. Leung
*Attorney, Agent, or Firm*—Spencer & Frank

[57] ABSTRACT

A microwave oven having a rotary grill heater 20 to be able to roast a food effectively and to prevent a horizontal rock between the joined grill heater and the cooking room 10 comprises a grill heater 20 in which is connected with the end sides of the grill heater 20, for rotating the grill heater 20 together and the rotary part has a first rotary part 30, 50 which is connected with one side of the grill heater 20 and a second rotary part 40, 60 which is connected with the other side of the grill heater 20 and is rotated with the rotation of the first rotary part 30, 50.

7 Claims, 5 Drawing Sheets

MICROWAVE OVEN HAVING ROTARY GRILL HEATER

FIELD OF THE INVENTION

The present invention relates to a microwave oven, more particularly to a microwave oven having a rotary grill heater.

BACKGROUND OF THE INVENTION

Conventional microwave oven is divided into two parts. One is a general microwave oven cooking foods put in the-inside of a cooking room by generating microwave. The other is an oven of a grill type cooking foods put in the inside of the cooking room by the heat generated in a grill heater.

FIG. 1 is a sectional view of the oven of the grill type roasting foods. As shown in FIG. 1, a grill heater 3 is equipped to a upper portion of side wall of a cooking room 2 in which a turntable 1 is equipped. The grill heater 3 is fixed in the hole formed in side wall of the cooking room 2.

In order to roast the foods, first, one puts a supporting box 4 on the turntable 1. After that, as power is supplied and one selects the mode for operating the grill heater, so, the grill heater 3 starts to generate heat. The fish on the supporting box 4 is roasted by the heat generated from the grill heater 3 so that is homogeneously cooked by the turn of the turntable 1.

According to such conventional art, however, the conventional microwave oven has a disadvantage that the supporting box is needed to roast the foods like as fish, meat etc. because the grill heater 3 is fixed at the upper portion of the cooking room 2. In addition, because only one side of the fish on the supporting box is exposed to the heat of the grill heater 3 and the other side is not, it has a problem that user has to open the door of the microwave oven and upset the fish on the midterm of the cooking.

Furthermore, it has a problem that the cleaning of the grill heater is inconvenient because the oil generated by cooking of the fish is attached on the rear side of the grill heater 3.

SUMMARY OF THE INVENTION

Accordingly, the present invention has been made to overcome the problems of the conventional art.

Therefore, an object of the present invention is to provide a microwave oven which can be rotary.

Another object of the present invention is to provide a microwave oven which can prevent the rock of the portion which the grill heater is connected with the cooking room.

These and other objects are achieved by a microwave oven having a rotary grill heater comprising a grill heater which the mid-portion is bent and a rotary means which is connected with the end sides of the grill heater, for rotating the grill heater together.

The rotary means comprises a first rotary means which is connected with one side of the grill heater, for controlling a rotary angle of the grill heater and a second rotary means which is connected with the other side of the grill heater and is rotated with the rotation of the first rotary means.

BRIEF DESCRIPTION OF THE DRAWINGS

The above object and other advantages of the present invention will become more apparent by describing the preferred embodiments thereof with reference to the accompanying drawings in which.

DETAILED DESCRIPTION OF THE INVENTION

Figure 1:
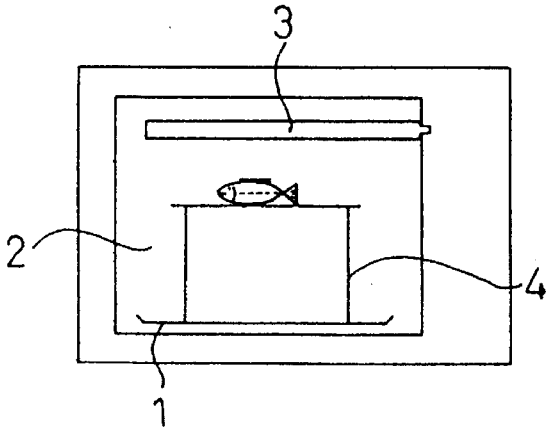
FIG. 1 PRIOR ART
FIG. 1 is a schematic diagram showing a grill heater of a fixed microwave oven in accordance with the conventional art.
Figure 2:
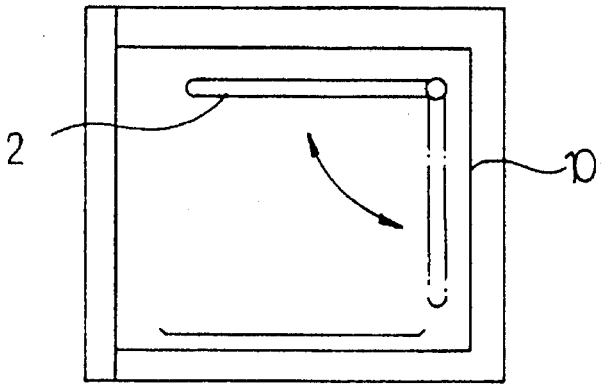
FIG. 2 is a side sectional view of a microwave oven showing a rotary grill heater in accordance with the present invention.

FIG. 2 is a side sectional view of a rotary microwave oven showing a rotary movement of the grill heater in accordance with the present invention.

As shown in FIG. 2, it shows that the grill heater 20 is able to be rotary during roasting cooking.

Figure 3:
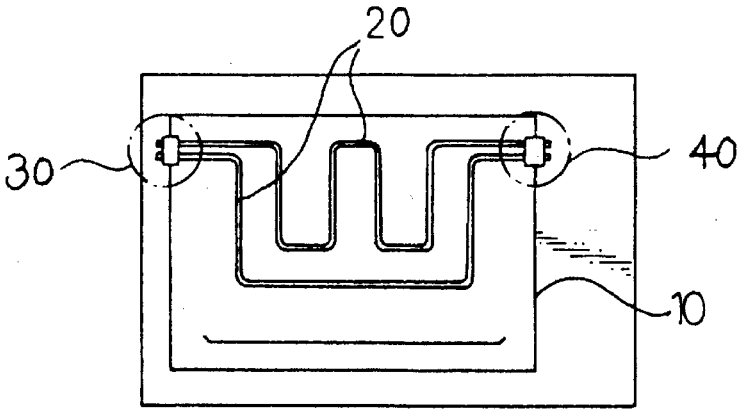
FIG. 3 is a schematic diagram showing the equipped view of the grill heater in accordance with the present invention.

FIG. 3 is a schematic diagram showing the equipped view of the grill heater in a cooking room.

As shown in FIG. 3, it shows that the grill heater is rotary to the vertical downward direction so as to cook the side or the reverse of a food which does not receive the generated heat directly. The grill heater 20 has a shape which the mid-portion of it is bent and is projected. The both sides of it are respectively connected to the side walls of the cooking room 10. Also, in order to control the rotary angle of the grill heater and prevent the horizontal rock of the connected grill heater, a left and a right rotary part 30, 40 are equipped.

Figure 4A:
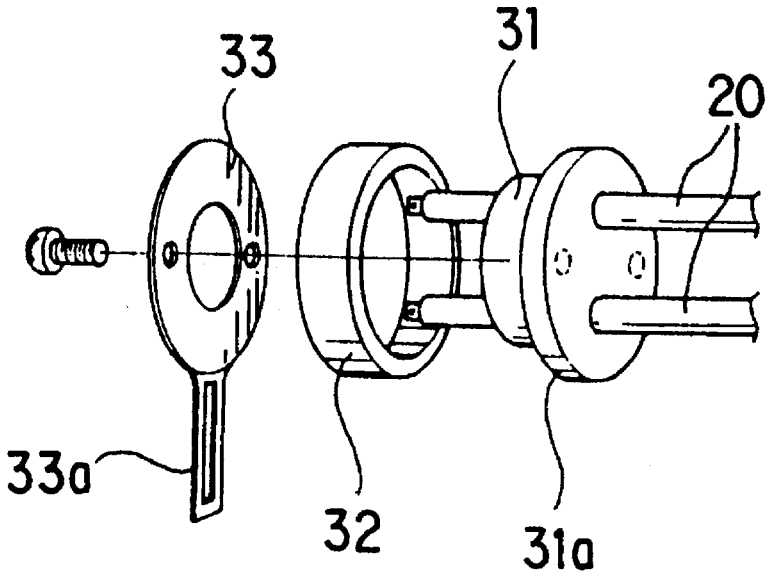
FIG. 4A is a exploded view of a left rotary part of the microwave oven in accordance with the present invention.
Figure 4B:
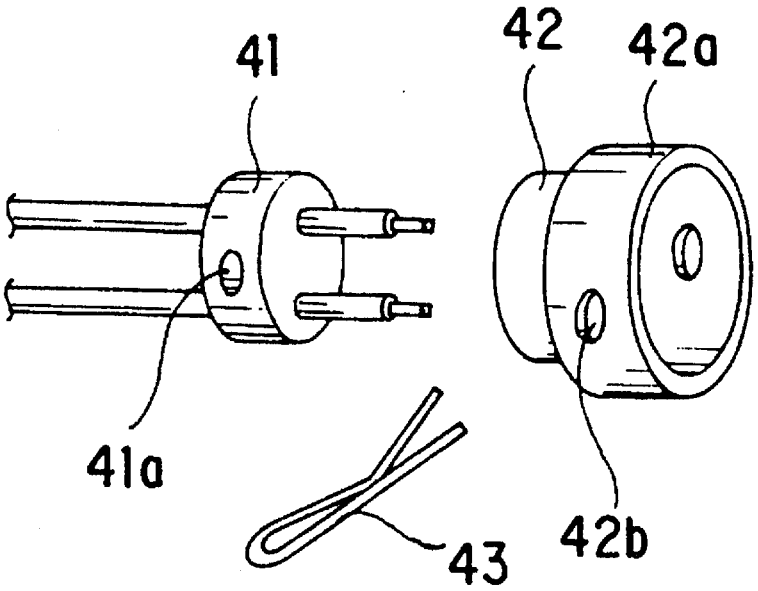
FIG. 4B is a exploded view of a right rotary part of the microwave oven in accordance with the present invention.
Figure 5:
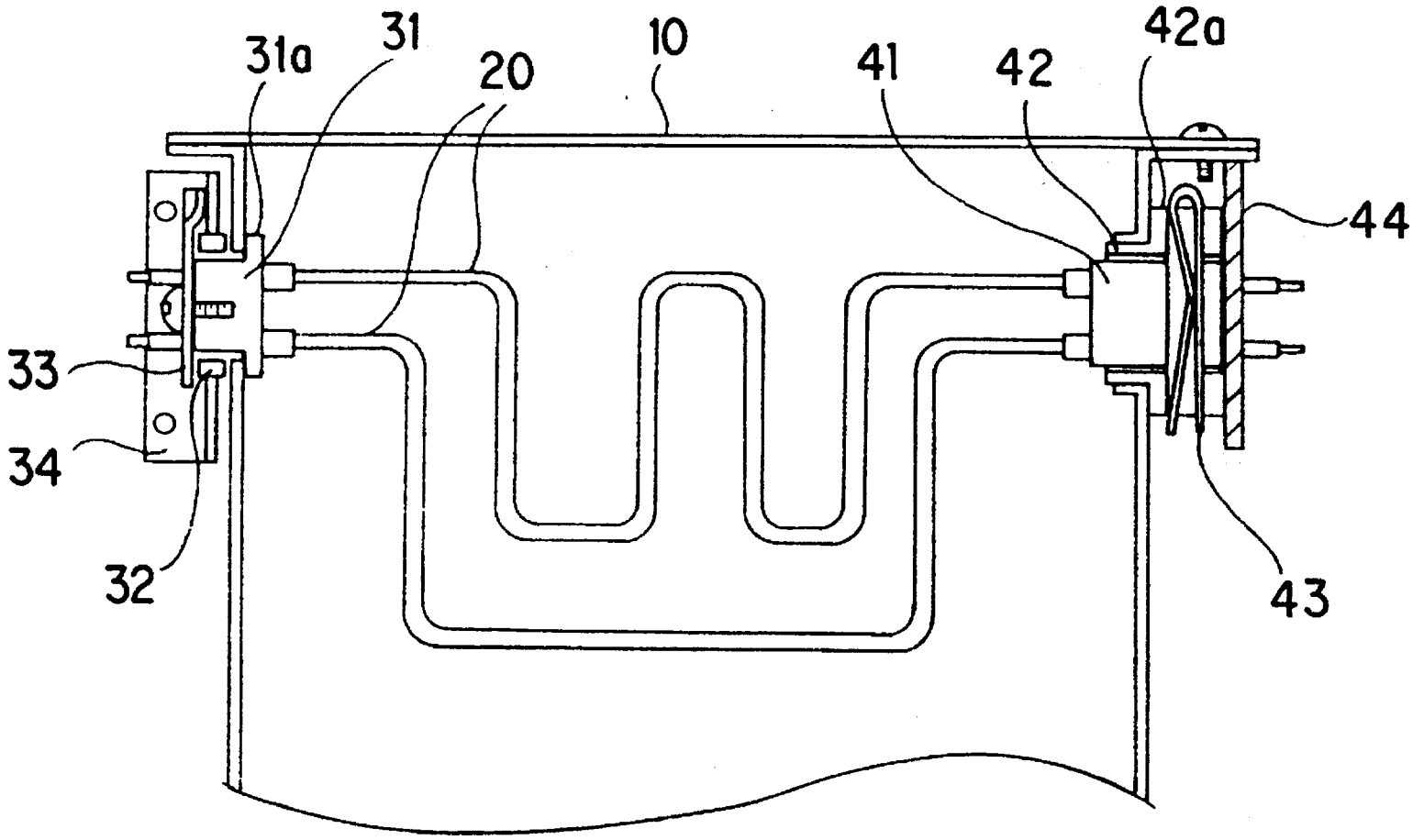
FIG. 5 is an enlarged view of FIG. 3.

Referring to one embodiment of FIG. 4 and 5, the construction of the rotary parts which make it possible to rotate the grill heater, is described.

First, as shown in FIG. 4A, the left rotary part 30 comprises a bushing which one ends of two grill heater are inserted through two holes formed in the bushing, wherein the bushing 31 is rotary with the grill heater together, a fixed cylindrical ring 32, a stopper 33 for rotating the grill heater 20 with the connected bushing 31 to a desired angle and a bracket 34 for defining the rotary angle of said stopper 33 and preventing the horizontal rock of the connected part.

As shown in FIG. 4B, the right rotary part 40 positioned at a certain portion of a right side wall of the cooking room 10, comprises a bushing 41 which the other ends of two grill heater 20 are inserted through two internal holes of it, and a rotary ring 42 which said busing 41 is inserted therein and a small cylindrical part of it is inserted in the right hole of the cooking room 10 from the outside of the wall of said cooking room 10 and having a circular holding member 42*a* and a bracket 44 for preventing the rotary ring 42 inserted at the right hole of the cooking room 10 from coming out the outside of the cooking room 10, wherein the bushing 41 and the rotary ring is joined by a pin 43 through holes 41*a*, 42*a* formed at the cylindrical surface of them.

When the grill heater 20 is not used, one moves it toward the inner wall by rotating the stopper 33, so that the space of the cooking room 10 is broad. In order to roast a food on the turntable, if one rotates the knob 33*a* of the stopper 33 to the desired position, the grill heater 20, the bushing 31 and the stopper 33 of the left rotary part 30 is rotated together. At the same time of the rotation of the left rotary part, the bushing 41 and the rotary ring 42 of the right rotary part 40 is rotated together.

At this time, the rock in the horizontal direction can be prevented by the bracket 34, 44 and the circular holding members 31*a*, 42*a*.

Figure 6A:
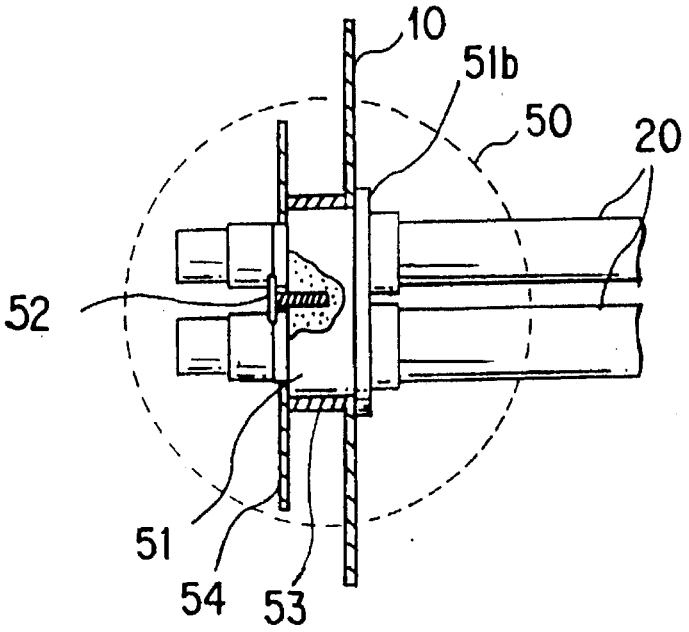
FIG. 6A is a partial sectional view of the left rotary part in accordance with one embodiment of the present invention.
Figure 6B:
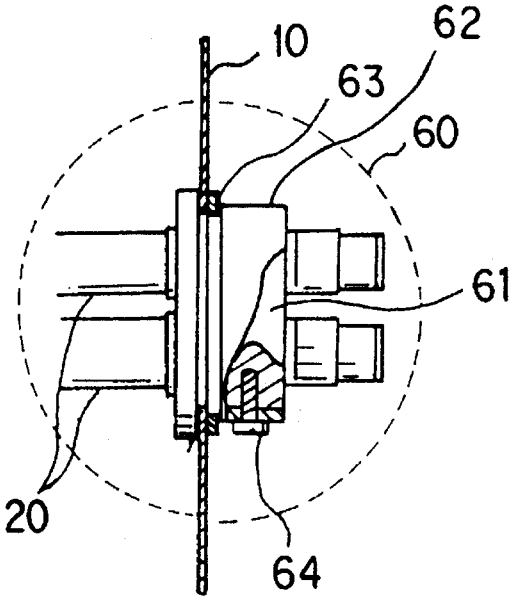
FIG. 6B is a partial sectional view of the right rotary part in accordance with one embodiment of the present invention.
Figure 7A:
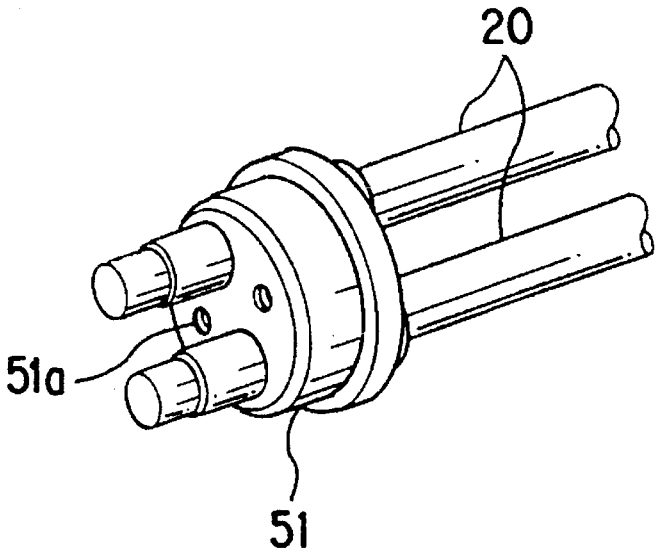
FIG. 7A is a perspective view of a bushing shown in the left rotary part of FIG. 6A.
Figure 7B:
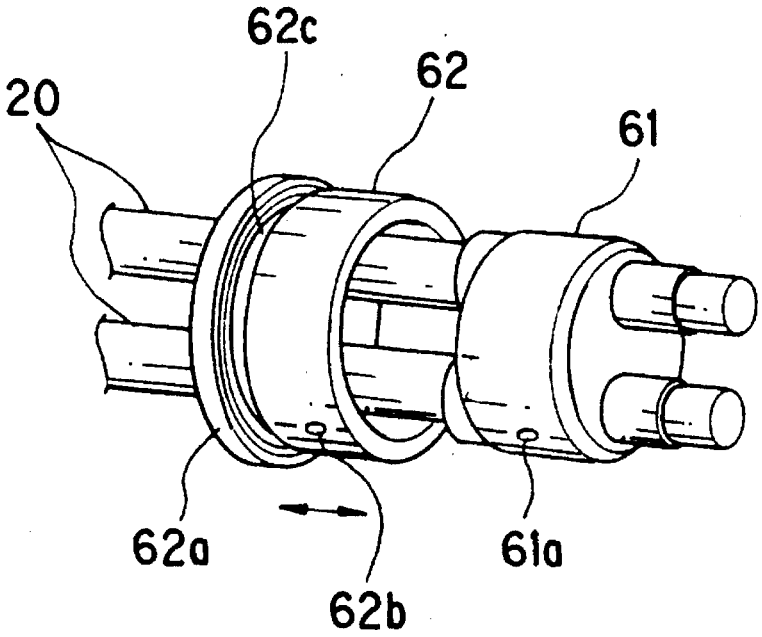
FIG. 7B is an exploded view of bushings shown in the right rotary part of FIG. 6B.

FIG. 6 and 7 are partial sectional view and perspective view of the rotary part in accordance with another embodiment of the present invention. As shown in the drawings, a left rotary part 50 positioned at the wall of the cooking room 10, comprises a first bushing having a circular holding member 51*b* for preventing the bushing inserted at the left hole of the cooking room 10 from coming out the left wall of the cooking room 10, a stop ring 53 which is inserted to the cylinder of said first bushing 51 and is fixed at the wall of the cooking room 10 and a stop plate 54 which is screwed with the first bushing.

In order to join the stop plate 54 to the first bushing together, each holes is formed in the sectional face of the bushing 51 and the face of the stop plate 54.

The hole 51*a* of the bushing 51 is shown in FIG. 7A and the hole of the stop ring is not shown in the drawings.

Meanwhile, a right rotary part 60 comprises a second bushing 61 in which the right ends of the two grill heater 20 is inserted, and a third bushing 62 in which said second bushing 61 is inserted.

The third bushing 62 is joined with the second bushing 61 from the inside of the cooking room 10 through the hole of the cooking room 10 and it has a circular holding member 62*a* for preventing the third bushing 62 inserted at the right hole of the cooking room 10 from coming out the outside, a groove 62*c* for preventing the inserted third bushing 62 from coming out between the right wall of the cooking room 10 and the groove 62*c* of the third bushing 62, an E-ring is joined. A screw 64 joins the third bushing 62 with the second bushing 61 through each holes 62*b*, 61*a*.

When a user roasts a food on the turntable using the microwave oven of the present invention, he can rotate a projection part of the grill heater 20 at a appropriate position for cooking using the stop plate 54 or the grill heater itself.

Accordingly, the present invention can simplify the steps for the roasting cooking and provide an effect that the cleaning of the grill heater itself and the walls of the cooking room is more easier than the conventional art.

Moreover, it can prevent the rock of the grill heater.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

What is claimed is:

1. A microwave oven having a rotary grill heater comprising:

a manually movable grill heater inside an oven cavity and having a mid-portion and opposite end sides, said mid-portion being bent and projected forward;

rotary means, which is connected with the end sides of the grill heater, for rotating the grill;

wherein said rotary means comprises;

first rotary means in which one end of the grill heater is inserted, for controlling a rotary angle of said inserted grill heater;

second rotary means in which the other end of the grill heater is inserted, and being rotated with the rotation of said first rotary means;

a first bushing mounted in a hole through a left wall of an oven cavity, one side of the grill heater being inserted in said first bushing, said first bushing having a cylindrical bushing portion and a circular holding member for preventing said first bushing from passing through the left wall of the oven cavity;

a cylindrical ring which is inserted on the cylindrical bushing portion of said first bushing and which is fixed at the wall of the oven cavity;

a stopper affixed to said first bushing for controlling the rotary angle of the joined bushing by rotating a knob formed at the stopper; and a bracket for defining the rotary angle of the knob.

2. A microwave oven having a rotary grill heater comprising:

a manually movable grill heater inside an oven cavity and having a mid-portion and opposite end sides, said mid-portion being bent and projected forward;

rotary means, which is connected with the end sides of the grill heater, for rotating the grill;

wherein said rotary means comprises;

first rotary means in which one end of the grill heater is inserted, for controlling a rotary angle of said inserted grill heater;

second rotary means in which the other end of the grill heater is inserted, and being rotated with the rotation of said first rotary means;

a bushing in which the other end of the grill heater is inserted;

a rotary ring, in which said bushing is inserted therein and joined, being rotated with said bushing in a hole of a right wall of the oven cavity, and having a circular holding member in contact with the hole of said right wall; and a bracket in contact with an outer sectional face of said rotary ring for preventing horizontal movement of the joined bushing and rotary ring.

3. A microwave oven having a rotary grill heater comprising:

a manually movable grill heater inside an oven cavity and having a mid-portion and opposite end sides, said mid-portion being bent and projected forward;

rotary means, which is connected with the end sides of the grill heater, for rotating the grill;

wherein said rotary means comprises;

first rotary means in which one end of the grill heater is inserted, for controlling a rotary angle of said inserted grill heater;

second rotary means in which the other end of the grill heater is inserted, and being rotated with the rotation of said first rotary means;

a first bushing in which the grill heater is inserted and fixed, and being rotated with the inserted grill heater;

a second bushing in which said first bushing is inserted and fixed, being rotated with the inserted grill heater, having a circular holding member contacted with an inner wall of the oven cavity, and a annular groove; and a ring is inserted in said groove and is contacted with an outer wall of the oven cavity.

4. A microwave oven comprising an oven cavity defined by walled surfaces including opposing right and left side walls, a top surface, a bottom cooking surface and a rear wall;

a U-shaped grill heater extending between upper rear portions of said side walls with the U-shaped portion extending forward beneath said top surface and means at each end of said grill heater for pivotly connecting said grill heater to a respective one of said side walls, wherein said grill heater is manually moveable in an arc between said top surface and said rear wall;

a first bushing mounted in a hole through a left wall of the oven cavity, one side of the grill heater being inserted in said first bushing, said first bushing having a cylindrical bushing portion and a circular holding member for preventing said first bushing from passing through the left wall of the oven cavity;

a cylindrical ring which is inserted on the cylindrical bushing portion of said first bushing and which is fixed at the wall of the oven cavity;

a stopper affixed to said first bushing for controlling the rotary angle of the joined bushing by rotating a knob formed at the stopper; and a bracket for defining the rotary angle of the knob.

5. The microwave oven as set forth in claim 4 further comprising a turn table on said bottom cooking surface.

6. The microwave oven as set forth in claim 4 wherein said grill heater includes two elements between the side walls.

7. A microwave oven comprising an oven cavity defined by walled surfaces including opposing right and left side walls, a top surface, a bottom cooking surface and a rear wall;

a U-shaped grill heater extending between upper rear portions of said side walls with the U-shaped portion extending forward beneath said top surface and means at each end of said grill heater for pivotly connecting said grill heater to a respective one of said side walls, wherein said grill heater is manually moveable in an arc between said top surface and said rear wall;

a bushing in which the other end of the grill heater are inserted;

a rotary ring, in which said bushing is inserted therein and joined, being rotated with said bushing in a hole of a right wall of the oven cavity, and having a circular holding member in contact with the hole of said right wall; and a bracket in contact with an outer sectional face of said rotary ring for preventing horizontal movement of the joined bushing and rotary ring.

* * * * *